United States Patent [19]

Cho

[11] Patent Number: 4,555,018

[45] Date of Patent: Nov. 26, 1985

[54] PORTABLE FOLDER TYPE PENCIL CASE

[76] Inventor: Hyon M. Cho, Room No. 1002, 105-dong, Woosung Apartment 239-1, Banpo-dong, Kangnam-ku, Seoul, Rep. of Korea

[21] Appl. No.: 574,516

[22] Filed: Jan. 27, 1984

[51] Int. Cl.[4] ..... B65D 85/28

[52] U.S. Cl. ..... 206/214; 150/131; 206/224; 206/371; 206/443; 206/460; 281/30

[58] Field of Search ..... 150/131, 132, 142, 143; 206/214, 224, 371, 443, 460; 24/10 R, 11 CT, 11 CC; 281/30, 31

[56] References Cited

U.S. PATENT DOCUMENTS

| | | | |
|---|---|---|---|
| 291,415 | 1/1884 | Spencer | 206/214 |
| 665,256 | 1/1901 | McComb | 281/30 |
| 1,489,796 | 4/1924 | Stoughton | 281/30 |
| 1,845,952 | 1/1932 | Wright | 281/30 |
| 2,366,457 | 1/1945 | Pinkham | 281/30 |
| 3,068,840 | 12/1962 | Pullins | 281/30 |
| 3,372,858 | 3/1968 | Brody | 281/31 |
| 4,296,945 | 10/1981 | Pavlik | 150/143 |
| 4,318,471 | 3/1982 | Hutton | 206/214 |
| 4,391,457 | 7/1983 | Gassner | 206/214 |
| 4,415,183 | 11/1983 | Benham | 281/31 |

*Primary Examiner*—George E. Lowrance
*Assistant Examiner*—Jimmy G. Foster
*Attorney, Agent, or Firm*—Oblon, Fisher, Spivak, McClelland & Maier

[57] ABSTRACT

A portable folder type pencil case, includes, a cover sheet panel being foldable in half and including first and second half panels each respectively having an inner half panel overlaid and joined on an inner side of the cover panel, the first inner half panel having a non-adhesive lateral mid-portion and the second half panel having an adhesive lateral mid-portion for overlapping with the lateral mid-portion upon folding of the case, a first and second guard strip panel wherein an outer end portion of the first half cover panel is joined with the first guard strip panel and an outer edge end portion of the second half cover panel is joined with the second guard strip panel, and a single-face adhesive panel strip connected to the cover sheet panel adjacent the second guard panel strip and including a panel strip for reinforcement of the single-face adhesive panel strip, the second guard strip panel having an adhesive back face for being selectively securely engaged with the first guard strip panel.

1 Claim, 7 Drawing Figures

PORTABLE FOLDER TYPE PENCIL CASE

BACKGROUND OF THE INVENTION

1. Field of the Invention

The present invention relates to a pencil case and, in particular, a folder type portable pencil case that may be carried separately or attached for carriage to a book or a notebook. In prior art, writing tools have been placed for carriage in a case of a certain size, which necessitates another bag to carry the case in.

2. Discussion of the Background

In some instances, a plurality of writing tools such as ballpens or fountain pens have been carried in pockets. Such a carriage however has some disadvantages, that not only limit the number of tools to carry and the carrier's physical activities but also results in spoils of clothes by ink or pencil in addition to a risk of loss.

SUMMARY OF THE INVENTION

The present invention intends to eliminate such disadvantages as described above by producing a handy folder type carrier case which comprises a foldable cover panel, an inner panel being press joined to the inside of said foldable panel along a vertical foldline and having a partially and laterally adhesive face portion, and guard strips at both ends of said foldable panel, and a reinforcing strip.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 4-B and C show modified applications of the embodiment in FIG. 4-A.

FIG. 4-D shows another modified application of the embodiment.

DESCRIPTION OF THE PREFERRED EMBODIMENTS

Figure 1:
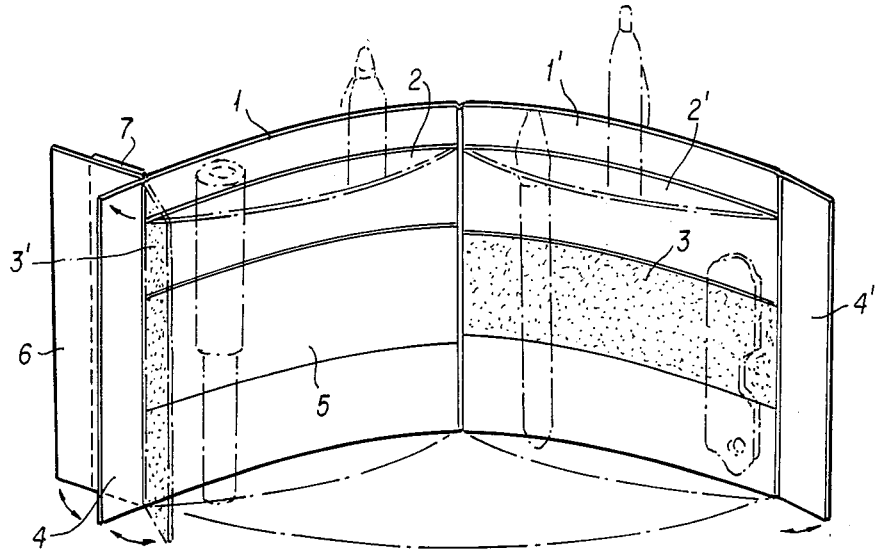
FIG. 1 shows a spread-open perspective view of an embodiment of the invention.
Figure 2:
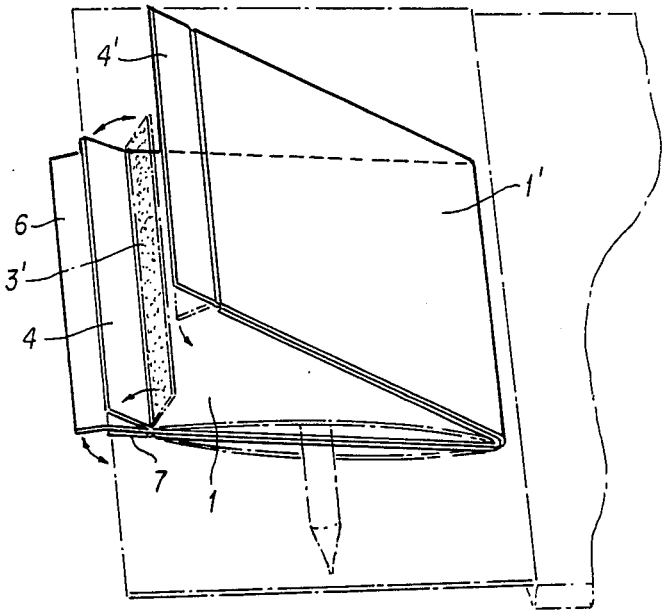
FIG. 2 shows a folded perspective view of the invention.

Numerals in the drawings indicate the following. Numerals 1 and 1' indicate respectively half panels of the foldable cover panel, 2 and 2' indicating respectively half panels of the inner panel, 3 and 3' adhesive panel-face portions, 4 and 4' guard panel strips, 5 a non-adhesive panel-face portion of the inner half panel 2, 6 an single-face adhesive panel strip, 7 a reinforcing panel strip. The invention shall be described in detail in reference to the drawings.

In the drawings, half panels 1 and 1' of a foldable cover panel are fixedly and overlayingly joined at opposite ends thereof to other half panels 2 and 2' of an inner foldable panel, both outer and inner panels being jointly foldable along a vertical fold line in middle and the upper edge line of the inner panel being dropped a step lower than that of the outer panel. This forms a first and second pocket as shown.

An adhesive face portion 3 is provided in the lateral mid-portion of the half panel portion 2' to match a non-adhesive face portion 5 provided in the opposite half panel portion 2. Outer end portions of the half panel 1 are overlappingly and adhesively joined with a guard strip panel 4 being integral with one-face adhesive panel strip 6 that is in turn integral in adhesion with a reinforcing strip panel 7. The operation and effects of the invention shall be described as follows.

In practical cases, any pen with a pocket clip is thrust through between the inner panels 2 and 2' and outer panels 1 and 1', the pocket clip clamping an upper edge of the panels 1, 1', 2 and 2'.

Any pencil, ballpen, eraser or knife is placed under adhesion on the adhesive portion 3 to be held for carriage in between the folded panel portions.

In use with a book or a notebook, the folder of the invention may be attached to the book by folding and overlapping the adhesive strip panel 6 over the inner edge portion of any side of the book cover.

Figure 3:
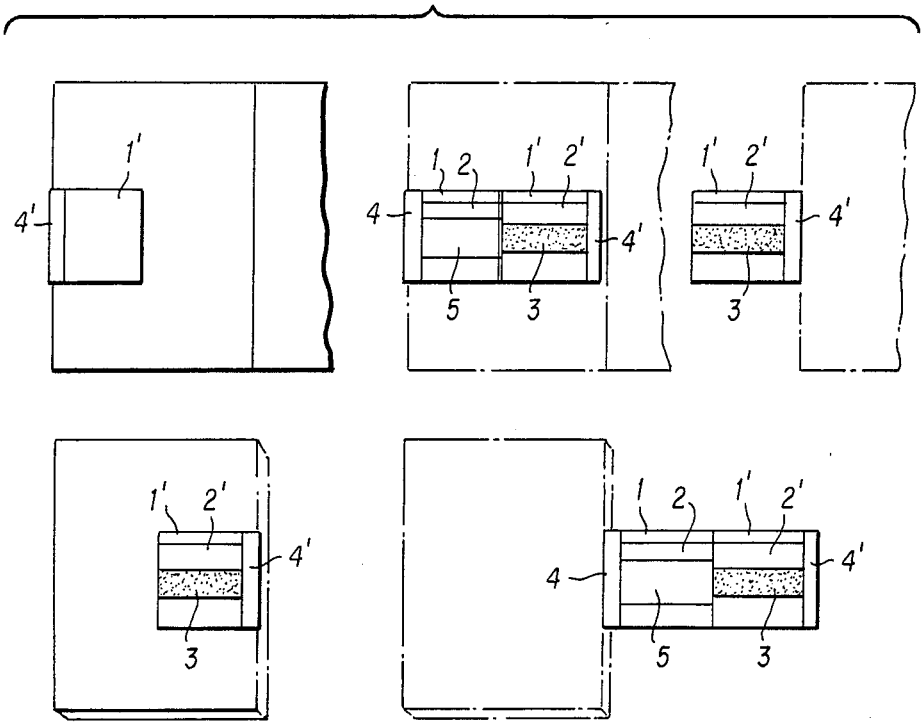
FIG. 3 shows varied forms of practical application of the invention.
Figure 4A:
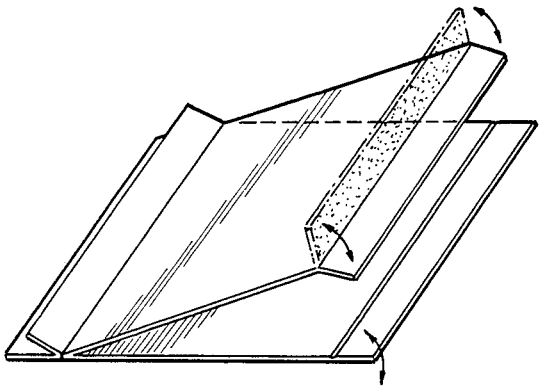
FIG. 4-A shows another form of application of the invention.
Figure 4B:
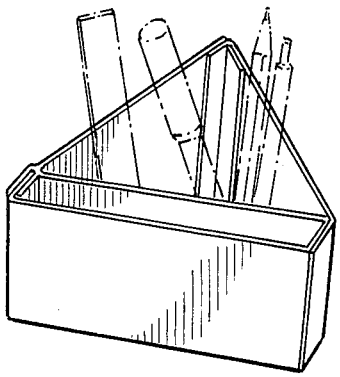
Figure 4C:
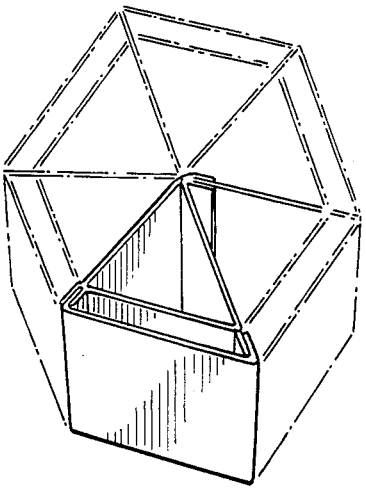
Figure 4D:
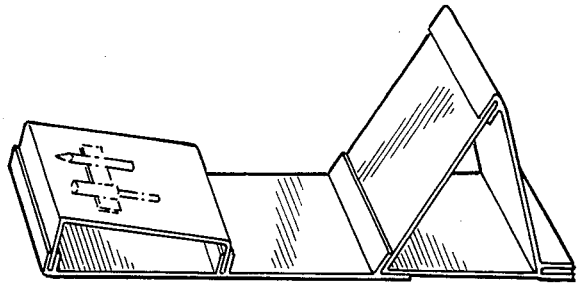

In necessity of use of a pen or a pencil in the course of carriage, the folded portions are spread open as shown in the FIG. 3.

When a pen or a pencil in use has to be put down for a while, it may simply be laid on the adhesive portion to remain there with no risk of loss.

An advantage of the invention is that pens or pencils are placed so as to be handy to reach and available at any time.

Another advantage of the invention is that when needed to carry many more pens or other writing tools the inner face of the guard strip 4' is overlappingly joined with the adhesive back face 3' of the guard strip 4, which itself is folded along fold lines away from strip 6 and toward strip panel 4', to form a triangular space in-between to carry more writing tools.

A further advantage of the invention is that a variety of table stands, such as pen stand or book stand shown in FIGS. 4A–D, may as pleased be constructed of a plurality of an pencil cases of the invention through modification and application within the range of conception of the invention.

Obviously, numerous modifications and variations of the present invention are possible in light of the above teachings. It is therefore to be understood that within the scope of the appended claims, the invention may be practiced otherwise than as specifically described herein.

What is claimed is:

1. A portable folder type case for holding writing utensils or the like, comprising:

a cover sheet panel being foldable in half and including first and second half panels each respectively having an inner half panel overlaid and joined at opposite ends thereof on a front face of said cover panel so as to form a first and second pocket for said utensils, said first inner half panel having a non-adhesive lateral mid-portion and said second inner half panel having an adhesive lateral mid-portion for supporting said writing utensils;

a first and second guard strip panel wherein an outer end portion of said first half cover panel is joined with said first guard strip panel and an outer edge end portion of said second half cover panel is joined with said second guard strip panel; and a single-face adhesive panel strip connected to said cover sheet panel adjacent said second guard panel strip and including a panel strip for reinforcement of said single-face adhesive panel strip and being foldable backward to support said case on a surface, said second guard strip panel having an adhesive back face for being selectively securely engaged with a front face of said first guard strip panel wherein said second guard strip panel is foldable along fold lines away from said single face adhesive panel strip and toward said first guard strip panel.

* * * * *